United States Patent [19]

Hamblin

[11] 4,065,165

[45] Dec. 27, 1977

[54] DOOR HANDLE MECHANISMS

[75] Inventor: Richard David Hamblin, Birmingham, England

[73] Assignee: Archibald Kenrick and Sons Limited, West Bromwich, England

[21] Appl. No.: 561,950

[22] Filed: Mar. 25, 1975

[30] Foreign Application Priority Data

Mar. 27, 1974 United Kingdom ..... 13535/74
Mar. 27, 1974 United Kingdom ..... 13544/74

[51] Int. Cl.[2] ..... E05C 21/00
[52] U.S. Cl. ..... 292/348
[58] Field of Search ..... 292/347, 348, 356; 70/134, 379 R

[56] References Cited

U.S. PATENT DOCUMENTS

| | | | |
|---|---|---|---|
| 2,573,061 | 10/1951 | Raymond | 70/379 R X |
| 2,803,482 | 8/1957 | Zion | 292/347 |

FOREIGN PATENT DOCUMENTS

| | | | |
|---|---|---|---|
| 855,898 | 2/1940 | France | 70/134 |
| 445,637 | 4/1936 | United Kingdom | 292/348 |
| 448,053 | 6/1936 | United Kingdom | 292/348 |
| 631,092 | 10/1949 | United Kingdom | 292/348 |

*Primary Examiner*—Richard E. Moore
*Attorney, Agent, or Firm*—Andrus, Sceales, Starke & Sawall

[57] ABSTRACT

A door handle mechanism comprising a handle having a spigot journalled in an opening in an attachment plate, the spigot having a circular section bore therein, means for limiting angular movement of the handle with respect to the attachment plate, spring means arranged to oppose angular movement of the handle in one direction, and a cam plate retaining the spigot in the attachment plate at least in part defining a hole shaped to non-rotatably engage with a non-circular section spindle.

14 Claims, 8 Drawing Figures

DOOR HANDLE MECHANISMS

This invention relates to door handle mechanisms of the kind comprising a handle, which may be a lever handle or a knob, and an attachment plate, the handle having a shank journalled in an opening in the attachment plate and retained therein by a member, means for limiting angular movement of the handle with respect to the attachment plate, spring means arranged to oppose angular movement of the handle in one direction and the shank having a bore therein to accommodate a non-circular spindle.

It is the object of this invention to provide a door handle mechanism of this kind in a simple and inexpensive but effective form.

According to the invention a door handle mechanism of the kind specified is characterised in that the bore in the shank is of circular section and the member retaining the shank spigot in the attachment plate also at least in part defining a hole shaped to non-rotatably engage with a non-circular section spindle.

Figures 1, 2, 3, 4:
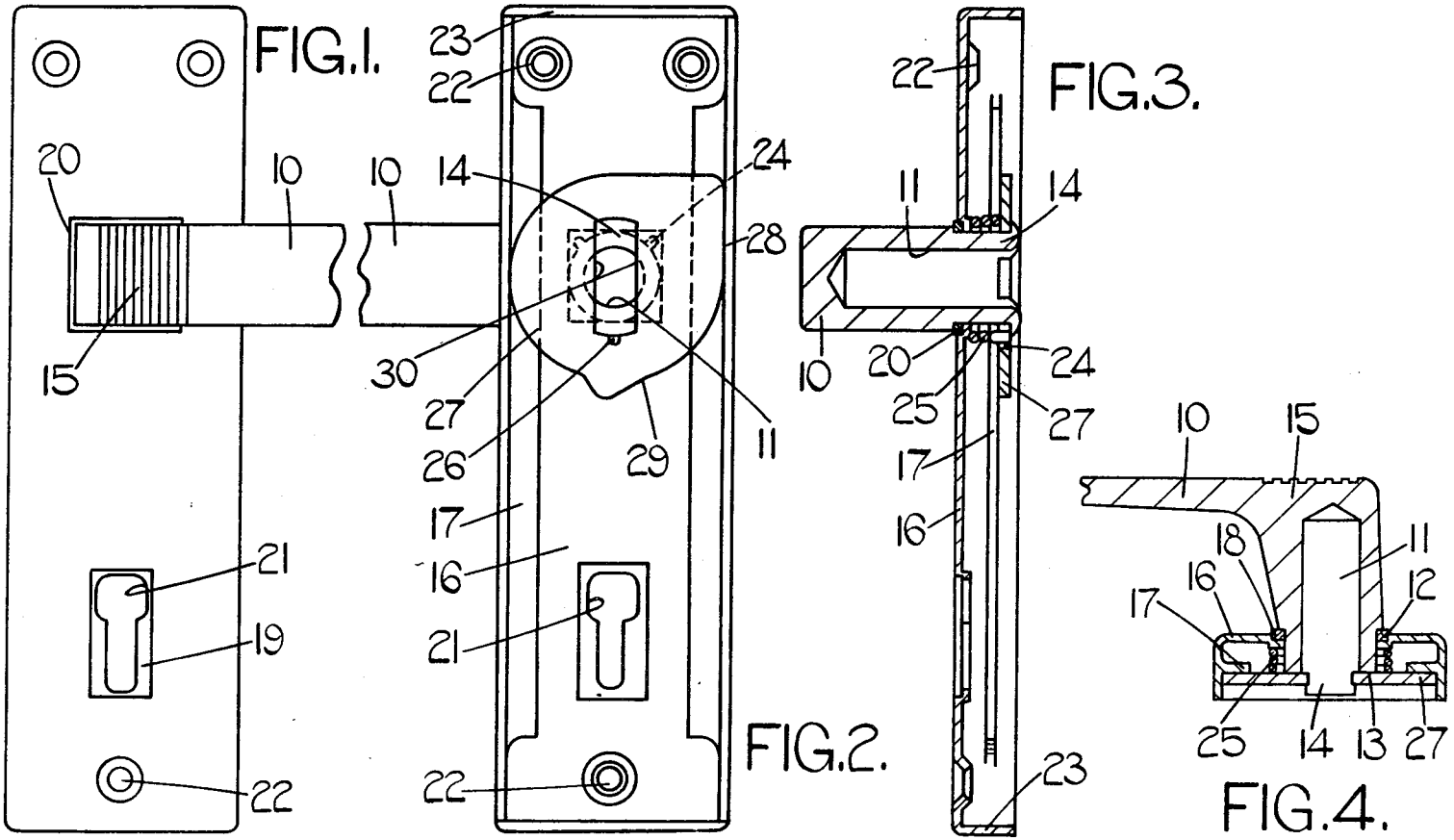
Figure 6:
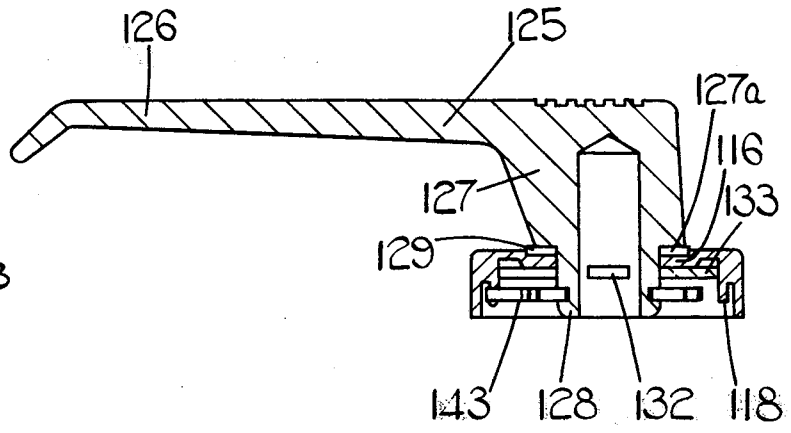
Figure 5:
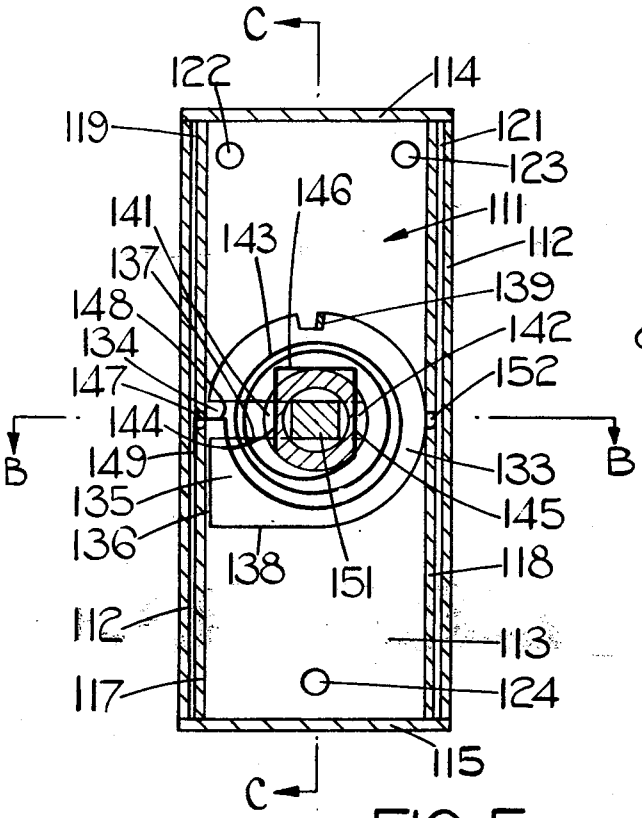
Figure 7:
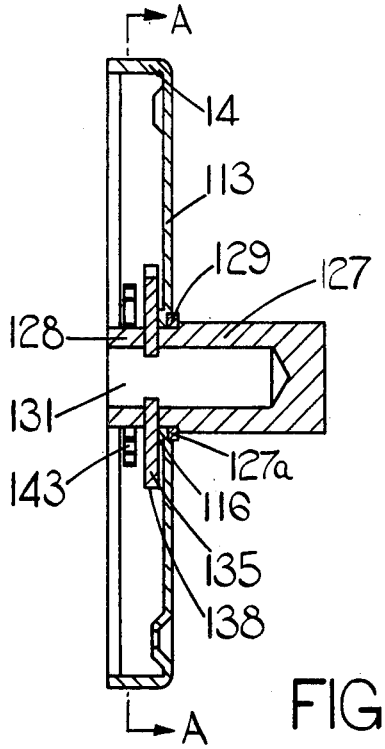
Figure 8:
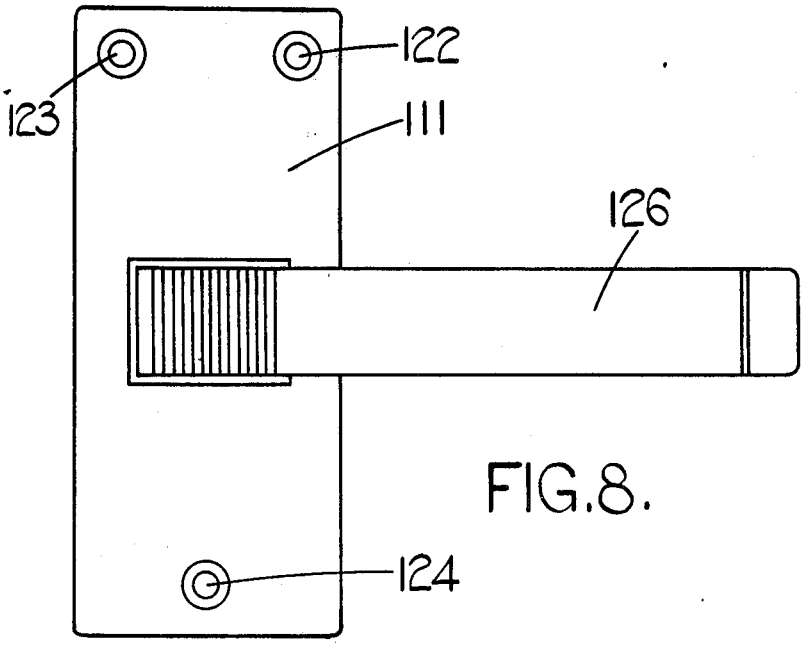

The invention will now be described, by way of example, with reference to the accompanying drawings in which:

FIG. 1 is a plan view of a lever door handle mechanism constructed in accordance with the invention, FIG. 2 is an inverted plan view thereof, FIG. 3 is a cross-sectional view in one plane, FIG. 4 is a cross-sectional view in a plane at right angles, FIG. 5 is a cross-sectional view on the line A—A in FIG. 7 of a further embodiment of the present invention, with the handle not shown, FIG. 6 is a cross-sectional view on the line B—B in FIG. 5 with the spindle not shown, FIG. 7 is a cross-sectional view on the line C—C in FIG. 5 with the spindle not shown, and FIG. 8 is a view in a direction opposite to that of FIG. 5.

The mechanism illustrated in FIGS. 1 to 4 comprises a lever handle 10 which is formed by extrusion, FIG. 4 showing the cross-sectional shape of the extrusion. The handle is generally of L-shape the shorter limb being wider and containing a circular section bore 11. The shape of the extrusion defines at the end of the shorter limb a pair of shoulders 12 defining a shank, and a further pair of shoulders 13 spaced lengthwise of the limb of the L. In the extrusion a rectangular projection separates the pair of shoulders 13. However, when the bore 11 is formed in the shorter limb of the handle, the bore breaks through this projection at the sides thereof adjacent the shoulders 13 to divide the projection into two parts. Concentrically with the bore 11, the projection is then machined to a diameter conforming with the width of the shoulders 13, so that these become annular shoulders. The two parts of the projection now define a pair of ears 14. Concentrically with the bore 11 the portion of the shank between the shoulders 12 and 13 is machined to a diameter conforming with the widths of the shoulders 12, so that these also becomes annular shoulders. The ears 14 are subsequently rolled or spun outwardly to retain the mechanism together as will be described.

The longer limb of the handle 10 in this example is decorated with ribs 15 but other styles may be adopted.

The spigot is journalled in an opening in an attachment plate 16 of generally rectangular configuration.

This attachment plate 16 is also extruded the section of the extrusion being substantially visible in FIG. 4. The section comprises a shallow channel the side walls of which are provided with respective inwardly presented flanges 17.

In the base of the channel there are formed two spaced shallow rectangular recesses 18, 19. These are in the outwardly presented face of the channel and in the recess 18 there is fitted a gasket 20 engaging the shoulder 12 of the handle 10. In the centre of the recess 19 there is provided a key hole shaped opening 21.

At each end the flanges 17 are cut away and at one end there are two fixing screw holes 22 and at the other end a single screw hole is provided. The sides of the channel are removed at the extremities of the attachment plate 16 and the base is bent up to form respective end plates 23.

The recess 18 has a circular hole in its centre in which the shank is journalled and in two adjacent corners of the recess there are small cut-outs 24 which are generally radial and which communicate with the circular hole in the centre of the recess 18.

Engaging in one or other of the cut-outs 24 is one axial end of a coiled torsion spring 25 the other axial end of the spring engages in a hole 26 in a plate 27. This plate 27 is non-rotatably secured to the shorter limb of the handle 10 by the two ears 14. It has a non-circular hole to conform with the ears and it rests against the shoulder 13 on the handle.

The external periphery of the plate 27 includes two straight edge portions 28, 29 which are joined by a portion having a radius equal to the distance from the pivot axis of the handle to the interior face of the sides of the channel of the attachment plate 16. Thus the two straight edge portions 28, 29 are tangential to such radius and can lie against such interior face of the attachment plate 16. The edge portion 28 is shown in such a position but rotation through 60° will bring the edge portion 29 into a similarly engaging position.

The torsion spring 25 is stressed to retain the handle in the position shown which is a rest position but it can be rotated through 60° to operate an associated latch against the action of the spring.

The plate 27 is flat and can be inverted to provide a mechanism which can be rotated in the opposite direction. This is needed for use on doors of opposite hand. Similarly the two cut-outs 24 in the recess 18 of the attachment plate 16 are provided for alternative engagement of the end of the torsion spring 25 in accordance with the direction of rotation of the handle which is required.

The shape of the hole in the plate 27 provides two parallel faces 30 which are spaced apart by a distance providing registration with a square spindle for the latch mechanism. The spindle is thus non-rotatably engaged in the hole. The plate 27 is moreover supported by the two coplanar flanges 17 extending inwardly from the sides of the channel of the attachment plate 16.

In an alternative construction employing the mechanism shown in FIGS. 1 to 4, the attachment plate is shorter and has no key hole.

A further embodiment of the present invention is shown in FIGS. 5 to 8.

The attachment plate 111 shown in FIGS. 5 to 8 is of channel shape in cross section. It comprises a pair of rectangular sides 112 integrally formed with and perpendicular to a rectangular plate 113. The channel formed by the pair of sides 112 and the plate 113 is closed at its ends by respective end pieces 114, 115 which are integrally formed with the plate 113. At a position in the centre of the plate 113 is a round bore. Around the bore is a dished concentric circular portion 116 of the plate 113. Formed integrally with the plate 113 and respective sides 112, along the length of the sides, are short internal flanges 117, 118 which extend parallel to respective sides 112, thus defining respective narrow channels 119, 121. The flanges 117, 118 are shorter than the sides 112. Also formed in the plate 113 are holes for receiving fixing means such as screws. Two such holes 122, 123 are located adjacent the end piece 114, each hole being equally spaced from a respective side 112. A further hole 124 is located midway between the sides 112, adjacent the end piece 115.

A handle 125, of generally L-shaped cross section is pivotally mounted in the attachment plate 111. The handle 125 comprises an arm 126 extending integrally from a boss 127. On the boss is an integral generally cylindrical shank 128. The spigot 128 is mounted in the bore in the plate 113, and a step **127*a* between the boss and the spigot abuts a friction washer 129 held in the dished portion of the plate 113. The shank 128 has a concentric cylindrical bore 131 therein, the bore 131 passing through a substantial part of the boss 127, as shown in FIGS. 6 and 7**.

The shank 128 is provided with a pair of diametrically opposed slots 132 occupying a plane parallel to the step **127*a*, one of these is shown in FIG. 6. The slots 132 are straight and extend in the direction of the length of the arm 126 of the handle 125, as shown in FIG. 5. Each slot in its mid region communicates with the bore 131. The distance between adjacent ends of opposite slots is equal to a side of a square spindle 151, shown in FIG. 5, which fits in the bore 131**.

A flat substantially circular plate 133 is located within the attachment plate 111. The plate 133 has a radially extending, substantially rectangular, open ended slot 134 therein. The diameter of the plate is equal to the internal distance between the flanges 117, 118. The plate 133 engages in the slots 132 in the spigot and abuts the dished portion 116 in the interior of the attachment plate 113. Parallel sides of the slot 134 extend through the spigot slots 132 into the bore 131, thereby partly defining a hole shaped to non-rotatably engage the square spindle 151 in the bore 131.

The plate 133 is formed with an integral stop portion 135 adjacent the slot 134. The stop portion 135 is of substantially rectangular form having one edge 136 which abuts the flange 117. An inner edge 137 is defined by the adjacent side of the slot 134 and an outer edge 138 joins the remaining circular portion of the plate 133 at a tangent thereto and midway between the sides 112.

On the periphery of the plate, at a position diametrically opposite the junction between the edge 138 and the circumferential edge of the plate 133, is integrally formed a lug 139, which extends perpendicularly from the plate 133 and has a depth equal to the height of the flanges 117, 118 above the plate 113. The lug 139 is formed by making a small radial cut inwardly from the circumference of the plate 133 and a further longer cut, joining the first cut,substantially at 90° thereto. The substantially rectangular portion thus produced is then bent upwardly from the plate.

The shank 128 has a further pair of diametrically opposed straight slots 141, 142. The slots 141, 142 are spaced lengthwise along the outer surface of the shank 128 from the slots 132, in a direction towards the extremity of the shank 128. The slots 141, 142 lie in a plane parallel to the plane containing the slots 132 but are arranged perpendicular thereto and do not extend through the shank 128 so as to communicate with the bore 131.

A coiled torsion spring 143 fits around the shank 128, being located in a plane through the slots 141, 142. One end of the spring 143 is hook shaped having two parallel portions 144, 145 integrally connected by a portion 146. The portions 144, 145 engage in the slots 141, 142 respectively, while the portion 146 fits around an outer surface of the spigot 128 between the slots 141, 142. The flange 117 is bored midway between the end pieces 114, 115 to produce a small gap 147, in the flange 117. This boring has its axis parallel to the axis of the bore 131. The other end of the spring 143 is of inverted L-shaped having a straight portion 148, integrally formed with the coiled part of the spring, and a further straignt portion 149 perpendicular to the portion 148. The portion 148 extends through the bore 147 and the portion 149 fits in the channel 119, thus securing the one end of the spring therein. The portion 148 is arranged to lie in a direction towards the end plate 115 when the mechanism is fitted as described.

The attachment plate 111 and the handle 125 are metal extrusions. The attachment plate section is shown in FIG. 6. To provide the end pieces 114, 115 the sides 112 and the flanges 117, 118 are locally cut away leaving extensions of the plate 113 which are bent inwards to close the channel in the attachment plate 111. The shape of the extrusion of the handle is substantially that shown in FIG. 6 without the bore 131 and slots 132. The slots 141, 142 are however provided in the extruded section. Having cut the required length from the extrusion it is necessary to machine the spigot into cylindrical form, from the initial square configuration and to drill the bore 131. Subsequently the slots 132 must be formed by milling or a similar process.

In order to assemble the door handle mechanism the following procedure is adopted. Firstly the spigot 128 is inserted through the bore in the attachment plate 111, the friction washer 129 being secured in the dished portion around the bore. The handle 125 is in a position reached by rotation through 90°, in an anti-clockwise direction, from the position shown in FIG. 5. In this position the slots 132 are parallel to the sides 112. The spindle 151 is now placed in the bore 131. The plate 133 is then slidably introduced into engagement with the slots 132 and the spindle 151. When in this position, the plate 133 abuts the dished portion 116 of the attachment plate. The handle 125 is then positioned as shown in FIG. 5 extending transversely of the length of the attachment plate. The hooked end of the spring 143 is then engaged in the slots 141, 142 in the spigot and the spring 143 is wound up in order to place the spring under tension. The other end of the spring is then engaged in the channel 119 as previously described.

Upon rotation of the handle 125 in an anti-clockwise direction with reference to FIG. 5, the plate 133, the shank 128 and the spindle 151 rotate together, the rotation increasing the tension in the spring 143. Rotation in this direction can be continued until the edge 138 of the stop portion 135 contacts the flange 118. When this position is reached the handle will have executed one quarter of a revolution. The lug 139 also prevents further rotation, by its engagement upon the straight portion 148 of the spring 143.

The handle is urged to return to the position shown in FIG. 5, by the spring, and when this position is reached, the edge 136 of the stop portion 135 of the plate 133, abuts the flange 117 thus preventing further rotation of the handle in this direction in a conventional manner. The spindle 151 is arranged to operate a latch on a door to which the mechanism is fitted.

Although the mechanism has been described in use as a right handed system, it can be easily adapted to a left handed system. This is achieved by forming the lug 139 on the opposite side of an equivalent to the plate 133 and then inserting the plate the opposite way round into the channel in the attachment plate 111. The spring 143 is inverted before its respective ends are engaged with shank 128, and a bore 152, in the flange 118, the bore 152 being similar to the bore 147.

In an alternative construction employing the mechanism shown in FIGS. 5 to 8, the attachment plate is of the form of the one shown in FIGS. 1 to 4.

I claim:

1. A door handle mechanism comprising a handle, a shank on said handle, the shank having a circular section bore therein, an attachment plate, the attachment plate having an opening therein, the shank being journalled in the opening in the attachment plate, a member non rotatably engaged on the shank and retaining it in the opening in the attachment plate, means for limiting angular movement of said handle with respect to said attachment plate, spring means arranged to oppose angular movement of said handle in one direction, two parallel inwardly presented edges on said member, said edges being disposed within the circular section bore in the shank and at least in part defining a hole shaped non-rotatably to engage a non-circular section spindle.

2. A door handle mechanism as claimed in claim 1 in which a pair of ears are provided at the end of the shank at which the plate is secured, the pair of ears passing through the hole in the plate and separating said inwardly presented edges, the ears extending substantially radially outwardly from the shank to prevent removal of the plate from said end of the shank.

3. A door handle mechanism as claimed in claim 1 in which the shank is provided with a pair of diametrically opposed slots communicating with the circular section bore in the shank, and the member non-rotatably engaged on the shank is a substantially circular plate having a slot therein, two edges of the slot providing said two parallel inwardly presented edges, said two parallel inwardly presented edges extending through said diametrically opposed slots into the circular section bore in the shank to retain the plate on the shank and at least in part to define said hole shaped non-rotatably to engage a non-circular section spindle.

4. A door handle mechanism as claimed in claim 3 in which the substantially circular plate has a pair of straight edges, said straight edges being mutually perpendicular and constituting said means for limiting angular movement of the handle, one of said pair of straight edges lying parallel to said two parallel inwardly presented edges of the slot in the substantially circular plate.

5. A door handle mechanism as claimed in claim 1 in which the member has a hole therein, the perimeter of which includes said parallel inwardly presented edges.

6. A door handle mechanism as claimed in claim 5 in which the member is a plate with an external periphery comprising two straight edge portions joined by a radiused portion to which they are tangential.

7. A door handle mechanism as claimed claim 2, in which the attachment plate comprises a channel having inwardly presented flanges extending from its side walls respectively, the plate being supported both by said flanges and by a pair of shoulders defined by said ears, when the plate is retained on the shank.

8. A door handle mechanism as claimed in claim 1 in which said spring means is a coiled torsion spring, one end of which engages in a cut-out communicating with the opening in the attachment plate and the other end of which engages in a hole in the member.

9. A door handle mechanism as claimed in claim 6 in which a rest position of the handle is achieved when one of said straight edge portions lies against a side wall of the attachment plate and a fully rotated position of the handle is achieved when the other of said straight edge portions lies against said side.

10. A door handle mechanism as claimed in claim 3 in which said shank is provided with a further pair of diametrically opposed slots spaced lengthwise from the slots communicating with the circular section bore, said further slots lying in a plane parallel to the plane containing the slots communicating with the circular bore, but being disposed at right angles thereto.

11. A door handle mechanism as claimed in claim 10 in which the spring means comprises a coiled spring, one end portion of which fits into said further pair of slots and the other end portion of which engages a flange of the attachment plate.

12. A door handle mechanism as claimed in claim 11 in which the circular plate is provided with an upstanding lug which engages said other end portion of the coiled spring, when the handle is in its fully rotated position.

13. A door handle mechanism as claimed in claim 1 in which the attachment plate is an extrusion.

14. A door handle mechanism as claimed in claim 1in which the handle is an extrusion.

* * * * *

UNITED STATES PATENT AND TRADEMARK OFFICE

CERTIFICATE OF CORRECTION

PATENT NO. : 4,065,165

DATED : December 27, 1977

INVENTOR(S) : Richard David Hamblin

It is certified that error appears in the above-identified patent and that said Letters Patent are hereby corrected as shown below:

Column 1, Line 20, delete "spigot"

Column 5, Line 35, delete the numeral "1" and substitute therefor ---6---

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*